US006182827B1

(12) United States Patent
Su

(10) Patent No.: US 6,182,827 B1
(45) Date of Patent: Feb. 6, 2001

(54) COMPARTMENTED FILE

(76) Inventor: Ken Jui Su, No. 180, Shu Wang 1st Road, Ta Li City, Taichung Hsien (TW)

( * ) Notice: Under 35 U.S.C. 154(b), the term of this patent shall be extended for 0 days.

(21) Appl. No.: 09/413,335

(22) Filed: Oct. 12, 1999

(51) Int. Cl.[7] ..... B25D 85/00
(52) U.S. Cl. ..... 206/425; 229/67.3; 229/67.1
(58) Field of Search ..... 206/425; 229/67.1, 229/67.3, 67.4

(56) References Cited

U.S. PATENT DOCUMENTS 1,121,446 * 12/1914 Alter ..... 229/67.1
1,488,616 * 4/1924 Robbins ..... 229/67.1
1,572,239 * 2/1926 Low ..... 229/67.1
4,485,962 * 12/1984 Farley ..... 229/67.1
5,593,086 * 1/1997 Ho ..... 229/67.3
5,630,509 5/1997 Su ..... 206/425
5,664,724 * 9/1997 Ho ..... 229/67.4
5,741,028 * 4/1998 Hatano et al. ..... 281/45

* cited by examiner

*Primary Examiner*—David T. Fidei
(74) *Attorney, Agent, or Firm*—Charles E. Baxley

(57) ABSTRACT

A compartmented file includes an outer file jacket having a front panel and a rear panel coupled together at a bottom coupling member, and one or more envelopes received in the outer file jacket and each having a front wall and a rear wall coupled together at a bottom coupling member which is secured to the coupling member of the outer file jacket. The coupling members of the envelopes and of the outer file jacket have different sizes for forming a flat bottom for each of the compartments formed between the panels and the walls of the outer file jacket and of the envelopes.

5 Claims, 4 Drawing Sheets

COMPARTMENTED FILE

BACKGROUND OF THE INVENTION

1. Field of the Invention The present invention relates to a file, and more particularly to a compartmented file.

2. Description of the Prior Art

The closest prior art of which the applicant is aware is his prior U.S. Pat. No. 5,630,509 to Su and comprise an accordion type configuration. However, the accordion portion of the file may not be solidly retained in place such that the documents may be easily disengaged from the file.

The present invention has arisen to mitigate and/or obviate the afore-described disadvantages of the conventional compartmented files.

SUMMARY OF THE INVENTION

The primary objective of the present invention is to provide a compartmented file including a solid structure having a number of compartments provided for solidly retaining the document therein.

In accordance with one aspect of the invention, there is provided a compartmented file comprising an outer file jacket including a front panel and a rear panel, the front panel and the rear panel including a bottom portion coupled together at a first coupling member, the outer file jacket including an enclosure flap for enclosing the outer file jacket, a file folder insert including a first envelope having a front wall and a rear wall, the front wall and the rear wall including a bottom portion coupled together at a second coupling member, the first envelope being received in the outer file jacket. The second coupling member of the first envelope is secured to the first coupling member of the outer file jacket for securing the first envelope to the outer file jacket.

The front panel and the rear panel of the outer file jacket include at least one side portion secured together at a side panel. The side panel is preferably a pleated side panel.

The rear panel of the outer file jacket includes the enclosure flap extended therefrom, the outer file jacket includes means for locking the enclosure flap to the front panel of the outer file jacket. The front panel of the outer file jacket includes a first locking member, the enclosure flap includes a second locking member for engaging with the first locking member and for locking the enclosure flap to the front panel of the outer file jacket.

The file folder insert includes at least one second envelope received in the first envelope, the at least one second envelope includes a front wall and a rear wall, the front wall and the rear wall of the at least one second envelope include a bottom portion coupled together at a third coupling member, the at least one second envelope is received in the first envelope, and the third coupling member of the at least one second envelope is secured to the second coupling member of the first envelope for defining a plurality of compartments between the front and the rear walls of the envelopes and the front and the rear panels of the outer file jacket.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
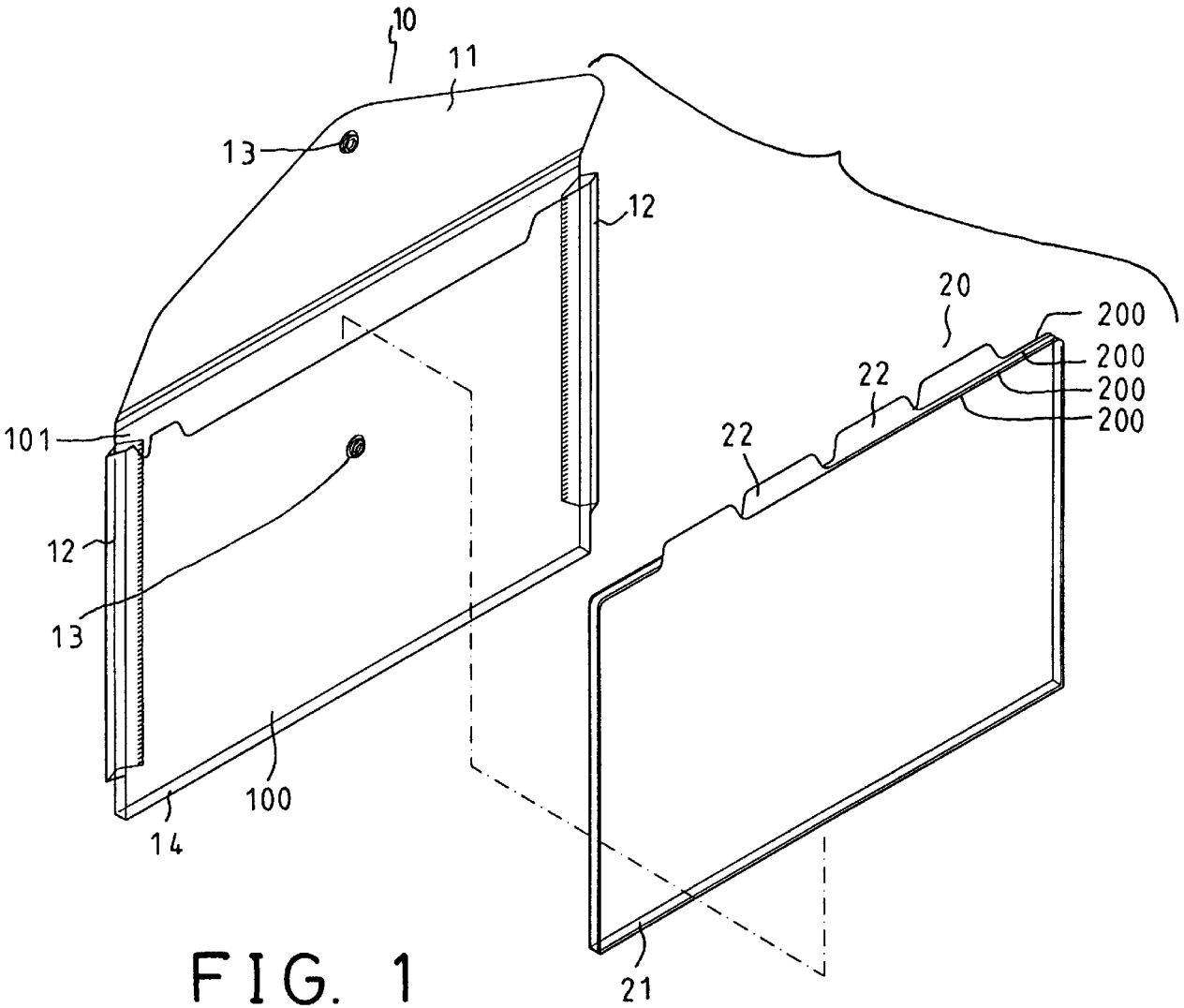
FIG. 1 is a partial exploded view of a compartmented file in accordance with the present invention, in which the insert envelopes are separated from each other.
Figure 2:
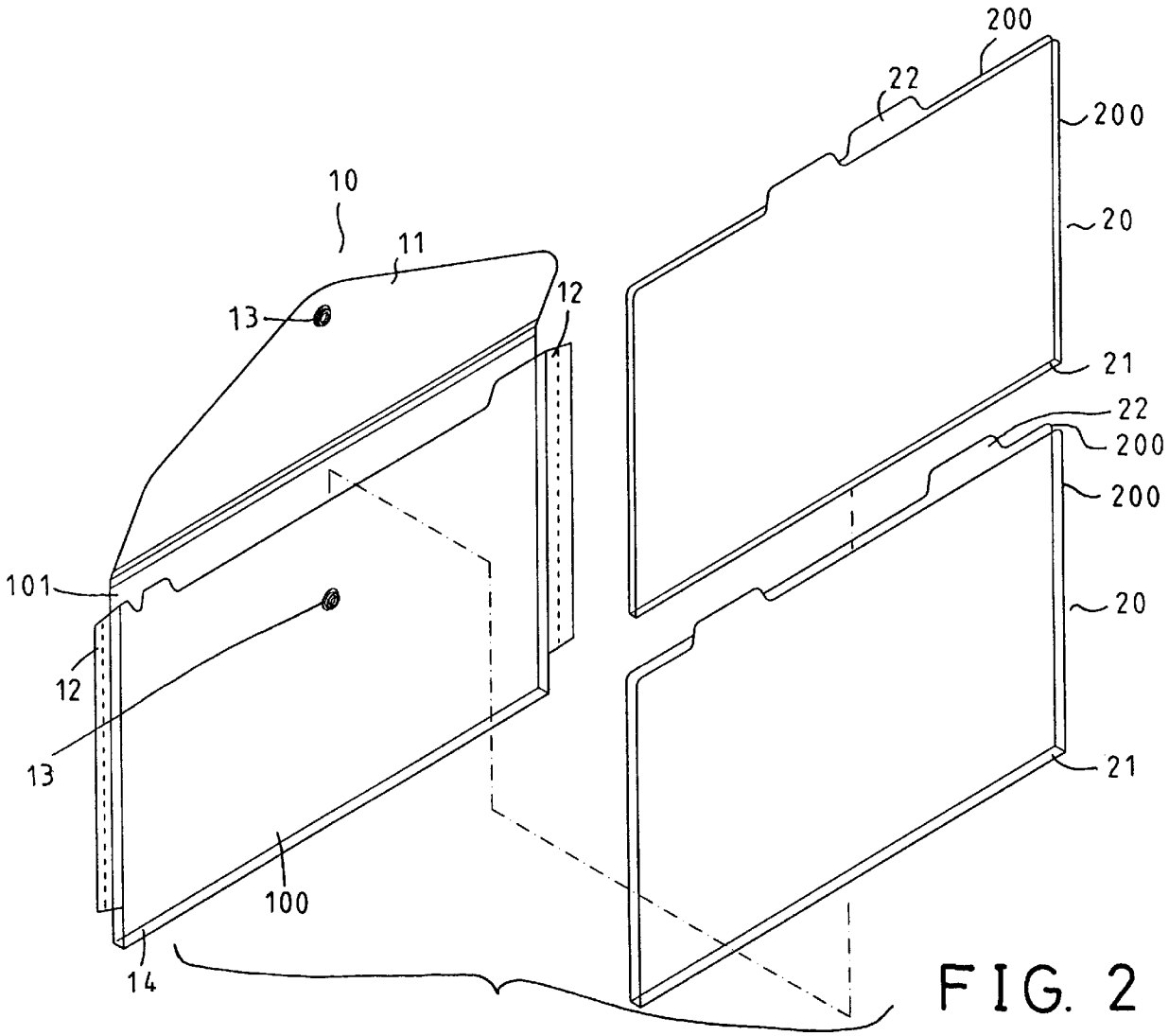
FIG. 2 is a partial exploded view of a compartmented file, in which the insert envelopes are secured together.
Figure 4:
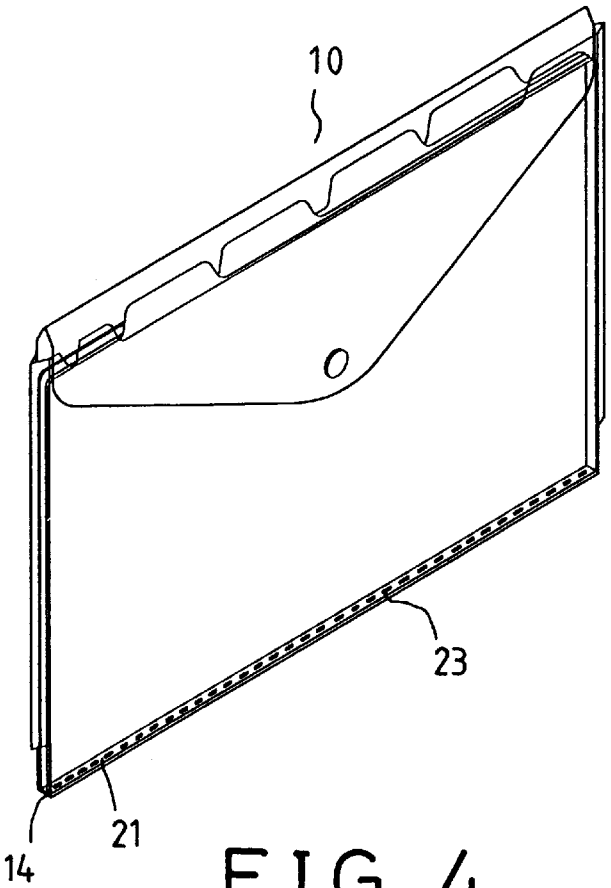
FIG. 4 is a perspective view of the compartmented file, in which the closure flap is in a closed position.
Figure 3:
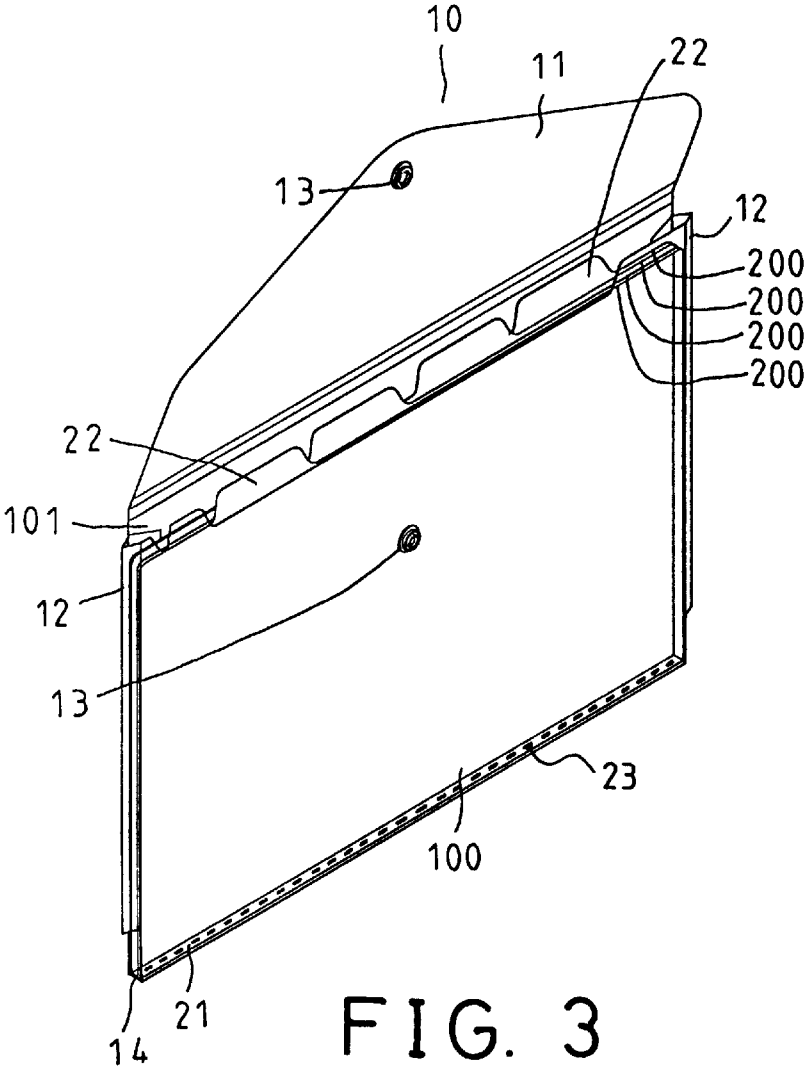
FIG. 3 is a perspective view of the compartmented file, in which the closure flap is not closed yet.
Figure 5:
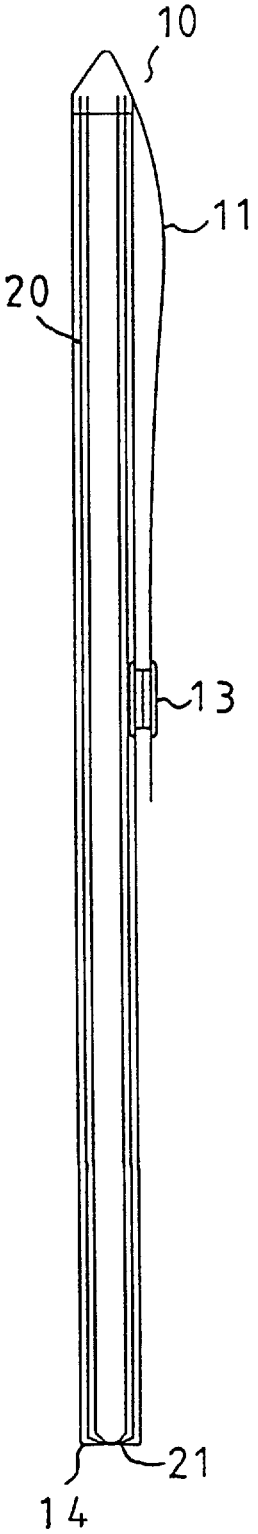
FIG. 5 is a side view of the compartmented file.
Figure 6:
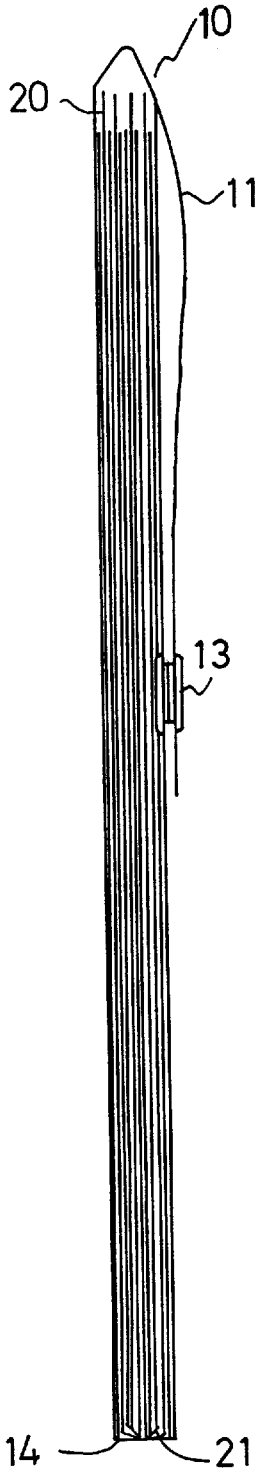
FIG. 6 is a side view similar to FIG. 5, illustrating the operation of the compartmented file.

Referring to the drawings, and initially to FIGS. 1–3, a compartmented file in accordance with the present invention comprises an outer file jacket 10 including a front panel 100 and a rear panel 101 having a bottom portion pivotally coupled together at a coupling member 14, such as a live hinge or a coupling strap. The front panel 100 and the rear panel 101 have one or both side portions secured together by a side panel 12 each, particularly a pleated side panel as shown in the drawings. The front panel 100, for example, includes two sides each having the side panel 12 extended therefrom (FIG. 1) and secured to the rear panel 101 by such as the welding process. The front panel 100 includes a locking member, such as a button 13 or a hook and loop device, attached to the outer portion thereof. The rear panel 101 includes a closure flap 11 extended upward therefrom and having a locking member, such as a button 13 or a hook and loop device, attached thereto for engaging with the locking member 13 of the front panel 100 and for enclosing the outer file jacket 10 of the compartmented file (FIGS. 4–6).

A file folder insert includes one or more envelopes 20 to be received in the outer file jacket 10. The envelopes 20 each includes a front wall 200 and a rear wall 200 having a bottom portion pivotally coupled together at a coupling member 21, such as a live hinge or a coupling strap. The front and the rear walls 200 of the envelopes 20 preferably each includes an upstanding tab 22 extended upward from the upper portion thereof for indexing purposes. As best shown in FIGS. 3–6, the coupling members 21 of the envelopes 20 may be secured together at such as the welding portions 23 as shown in FIGS. 3, 4, and are different from each other such that the intermediate envelopes 20 may be received in the outer envelope 20, and such that a number of compartments may be formed between the walls 200 of the envelopes 20. The outer envelope 20 is received in the outer file jacket 10, and the coupling members 21, 14 of the envelopes 20 and the outer file jacket 10 may also be secured together at the welding portions 23.

It is preferable that the coupling member 14 of the outer file jacket 10 has a size greater than the coupling members 21 of the envelopes 20 such that the envelopes 20 may be stably and solidly retained in the outer file jacket 10. Two more compartments may be formed between the panels 100, 101 of the outer file jacket 10 and the outer envelope 20. The compartments formed between the walls 200 of the envelopes 20 and the panels 100, 101 of the outer file jacket 10 may thus each include a flat bottom portion defined by the coupling members 14, 21 of the outer file jacket 10 and the envelopes 20, such that the various documents received in the compartments may be stably retained in place and the bottom portions of the documents will not be squeezed upward and outward of the compartments.

Accordingly, the compartmented file in accordance with the present invention includes a solid structure having a number of compartments provided for solidly retaining the document therein.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A compartmented file comprising:

an outer file jacket including a front panel and a rear panel, said front panel and said rear panel including a bottom portion coupled together at a first coupling member, said outer file jacket including an enclosure flap for enclosing said outer file jacket, a file folder insert including a first envelope having a front wall and a rear wall, said front wall and said rear wall including a bottom portion coupled together at a second coupling member, said first envelope being received in said outer file jacket, said second coupling member of said first envelope being secured to said first coupling member of said outer file jacket for securing said first envelope to said outer file jacket, and said file folder insert including at least one second envelope received in said first envelope, said at least one second envelope including a front wall and a rear wall, said front wall and said rear wall of said at least one second envelope including a bottom portion coupled together at a third coupling member, said at least one second envelope being received in said first envelope, and said third coupling member of said at least one second envelope being secured to said second coupling member of said first envelope for defining a plurality of compartments between said front and said rear walls of said envelopes and said front and said rear panels of said outer file jacket.

2. The compartmented file according to claim 1, wherein said front panel and said rear panel of said outer file jacket include at least one side portion secured together at a side panel.

3. The compartmented file according to claim 2, wherein said side panel is a pleated side panel.

4. The compartmented file according to claim 1, wherein said rear panel of said outer file jacket includes said enclosure flap extended therefrom, said outer file jacket includes means for locking said enclosure flap to said front panel of said outer file jacket.

5. The compartmented file according to claim 4, wherein said front panel of said outer file jacket includes a first locking member, said enclosure flap includes a second locking member for engaging with said first locking member and for locking said enclosure flap to said front panel of said outer file jacket.

* * * * *